US005157837A

United States Patent [19]

Rose

[11] Patent Number: 5,157,837

[45] Date of Patent: * Oct. 27, 1992

[54] CUTTING IMPLEMENT

[76] Inventor: Anthony T. Rose, 741 Lakefield Rd., Westlake Village, Calif. 91361

[ * ] Notice: The portion of the term of this patent subsequent to Jan. 2, 2007 has been disclaimed.

[21] Appl. No.: 634,437

[22] Filed: Dec. 27, 1990

[51] Int. Cl.[5] ..... B26B 13/00

[52] U.S. Cl. ..... 30/260; 30/349

[58] Field of Search ..... 30/260, 349, 254, 346, 30/357, 329, 330, 339, 258, 351

[56] References Cited

U.S. PATENT DOCUMENTS

| | | | |
|---|---|---|---|
| 891,238 | 6/1908 | Feinenburg | 30/349 |
| 910,008 | 1/1909 | Melchior | 30/349 |
| 1,181,871 | 5/1916 | Graham | 30/349 |
| 1,532,850 | 4/1925 | Yard | 30/349 |
| 1,628,856 | 5/1927 | Patrick | 30/349 |
| 1,696,323 | 12/1928 | Patrick | 30/349 |
| 1,748,701 | 2/1930 | Boyd | 30/349 |
| 2,082,502 | 6/1937 | McCaw | 30/349 |
| 2.584,603 | 2/1952 | McMillan et al. | 30/349 |
| 3.377,703 | 4/1968 | Longobardi | 30/330 |
| 4,890,388 | 1/1990 | Rose | 30/349 |

*Primary Examiner*—Frank T. Yost
*Assistant Examiner*—Hwei-Siu Payer
*Attorney, Agent, or Firm*—Roger A. Marrs

[57] ABSTRACT

A cutting implement of the scissors type is disclosed herein having a pair of elongated shanks pivoted together midway between their opposite ends so that opposing cutting edges converge together as the shanks are closed towards one another. The cutting edges are carried on an exposed edge marginal region of replaceable blades insertably disposed into open receptacles on the respective shanks. Each shank receptacle is defined by sloping surfaces at the opposite ends of each receptacle and a pair of posts is provided in spaced relationship between the opposite opening ends. The blade is formed with a plurality of recesses along the edge opposite to the cutting edge leading into longitudinal slots whereby the shank posts are indexed or registered with the blade recesses for snap-lock retention therewith into the slots. Guidance is provided by cooperating alignment of the posts with shaped slopes of the blade while positive retention is provided by a rounded bead yieldably occupying the area of a selected recess leading into a slot. Extraction mechanism is provided for automatic blade removal wherein the rearmost corners of the blades cooperate together when the scissor shanks are converged to forcibly urge the blades out of snap-lock retention.

2 Claims, 2 Drawing Sheets

CUTTING IMPLEMENT

BACKGROUND OF THE INVENTION

1. Field of the Invention

The present invention relates to the field of scissors, shears and similar cutting implements and more particularly to a novel cutting implement having removable or replaceable shank inserts or cutting blades therefor.

2. Brief Description of the Prior Art

In the past, major inconveniences to which a surgeon, barber or other worker who constantly used scissors had to contend with was the problem of maintaining a sharp, keen cutting edge on the instrument in order to perform the best work. The user would have to continually maintain these sharp instruments in order to obtain proper performance. This problem is also presented to a surgeon who, in addition, is faced with the problem of sanitation of his surgical scissors Therefore, attempts have been made to utilize interchangeable cutting blades adapted to be mounted on the shanks of scissors or the like for easy and quick removal without damage to the latter. However, problems have been encountered which stem largely from the fact that insertion of removable blades into the respective shanks is not guided and relies solely on feel and visual observation. Also, removal of blades, when dull or damaged, is difficult and generally requires the two hands of the user to successfully eject or remove blades In other instances, problems have been encountered with premature release or lack or retention for the blades on the shank so that blades sometimes dislodged and fell from the shank when in use.

When such prior implements are used in specialized situations, such as when surgical instruments are employed, extremely hard and dense materials are used for producing the scissors or implement. Such compositions are difficult, and therefore expensive to drill, form or otherwise provide the necessary recesses, openings, apertures or the like in order to fabricate a high performance instrument. The cost involves not only highly skilled labor but the cost of cutting implements which are required to form the surgical steel used in the fabrication of such instruments.

Therefore, a long standing need has existed to provide a cutting implement which not only has replaceable blades, but which is self-indexing or registering so that the replaceable blade may be automatically installed or ejected from its location on the implement. Additionally, it is preferred to have a positive retention means for holding the replaceable blade in position so that it will not be inadvertently dislodged.

SUMMARY OF THE INVENTION

Accordingly, the above problems and difficulties are obviated by the present invention which provides a novel cutting implement having an elongated shank or holder provided with a shaped recess for insertably receiving a replaceable blade. The recess is provided with contoured surfaces defining the respective ends of the opening or recess so that insertion and ejection of the blade is self-locating and self-ejecting when urged into or out of the recess or opening. Guide means are respectively and cooperatively carried on the replaceable blade and the implement within the opening for positive retention when the replaceable blade has been properly located within the opening. Such positive retention is yieldable for release by forcible engagement with an end shoulder exposed for the purpose of engagement by a removal tool or means. The shaped surfaces for guidance and alignment of the replaceable blade within the shank of the implement are placed at aligned angles with respect to one another so as to permit relatively convenient and inexpensive formation utilizing surgical steel as the composition for the implement.

Therefore, it is among the primary objects of the present invention to provide a cutting device utilizing interchangeable cutting blades which are adapted to be mounted in such a way for easy and quick removal without damage to the implement or the user.

Another object of the present invention is to provide a novel cutting device incorporating a replaceable cutting blade in the form of an insert adapted to be guided into and out of a receiving opening on the implement and which is relatively economical to manufacture and to use.

Another object of the present invention is to provide a novel cutting implement having replaceable cutting blades which are sufficiently inexpensive to permit disposal thereof when dull or damaged once they have lost their cutting edge or have become contaminated.

Still a further object of the present invention is to provide a novel cutting implement, having replaceable blades, which includes self-indexing or registering means for automatically located a replaceable blade on the instrument and which further includes a positive, snap-lock retention means for yieldably holding the replaceable blade in the location.

A further object of the present invention is to provide a novel cutting device, utilizing replaceable blades, which incorporates a positive retention means on a shank for releasably holding the replaceable blade in position, and which further includes centering or guidance means for locating a respective replaceable cutting blade on the shank so that it is in position to perform its intended purpose.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
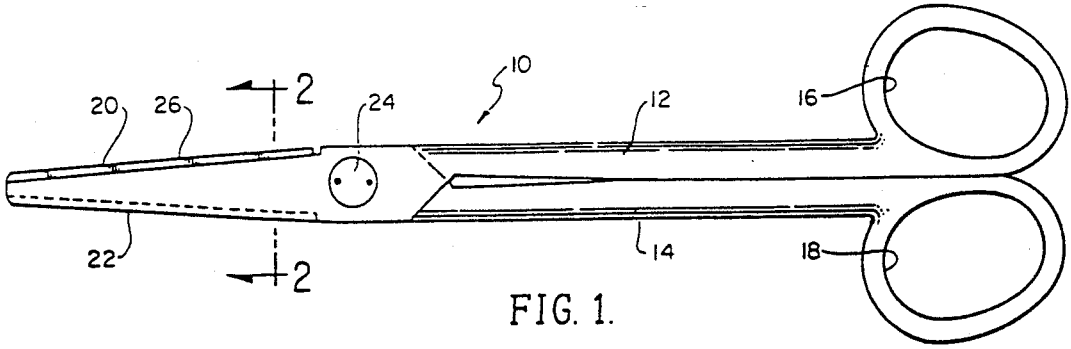
FIG. 1 is a front elevational view of a cutting device in the form of a scissors incorporating the interchangeable cutting blades of the present invention.

Referring now to FIG. 1, the novel cutting implement or device of the present invention is illustrated in the general direction of arrow 10 which takes the form, in one version, of a scissors being formed with a first shank 12 and a second shank 14. The rear ends of the shanks 12 and 14 are formed into openings 16 and 18 respectively, to facilitate cooperation with the fingers of a person using the implement. The forward end of each of the shanks 12 and 14 is formed into blades 20 and 22 respectively. Blades 20 and 22 are to be movable together in an abutting relationship by means of movement of the shanks 12 and 14 about a pivot connection 24.

Figure 2:
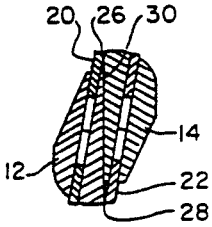
FIG. 2 is a transverse cross-sectional view of the shanks of the cutting device shown in FIG. 1 as taken in the direction of arrows 2—2 thereof.

Referring now in detail to FIG. 2, it can be seen that the respective blades 20 and 22 include cutting edges 26 and 28 which engage with each other along a shear line defined by the opposing and abutting surfaces of the forward end of shanks 12 and 14 respectively. The shear line is indicated by the numeral 30.

Figure 3:
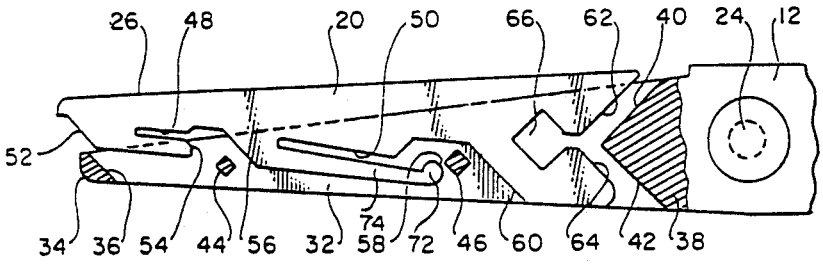
FIG. 3 is an enlarged fragmentary sectional view of a shank of the scissors shown in FIG. 1, illustrating the replaceable blade preparatory for insertion into an opening of the shank.

Referring now in detail to FIG. 3, it can be seen that the forward end of shank 12 is formed with an elongated opening indicated in general by numeral 32, which is defined at its opposite ends by a nose portion 34, having an angular or sloping surface 36, and a tail portion 38 having converging, sloping surfaces 40 and 42 respectively. Midway between the angular surfaces 36 and 42, guide cross elements 44 and 46 are provided, which interconnect opposite sidewalls of the forward end of the shank 12. Therefore, it can be seen that each forward end of a shank includes an elongated opening defined by sloping surfaces at the opposite ends of the opening, which are defined by portions 34 and 38 respectively.

It is also to be noted that the square or diamond shape of the cross posts 44 and 46 includes external surfaces which run in parallel with respect to the surface 36 and the surfaces 40 and 42 respectively. These surfaces form guide means for directing the replaceable cutting blade while being inserted into the opening 32. Guide means are included which cooperate with conformal surfaces provided on the replaceable cutting blade 20 in order to effect correct insertion of the blade into the opening and, ultimately, to provide positive retention.

With respect to the blade 20, it can be seen in FIG. 3 that the blade includes a cutting edge 26 along one side while the opposite side is provided with a pair of recesses leading into elongated slots 48 and 50 respectively. During insertion, the cross posts 44 and 46 are aligned with the recesses and as the blade is slipped through the opening 32, the blade is forced rearwardly by the engagement of slope 36 with a forward inclined surface 52 on the blade and engagement of the external surfaces of the cross posts 44 and 46 with surfaces 54 and 56 of the first recess leading into slot 48, and by means of opposing, sloping surfaces 58 and 60, defining the other recess associated with slot 50 and the external surfaces of the cross post 46.

The rearmost terminating end of the replaceable blade 20 includes a dovetail pair of surfaces 62 and 64 which mate with surfaces 40 and 42 to provide positive alignment and registry for locating the blade within the opening 32. The surfaces 62 and 64 terminate in a converging fashion with an opening 66 so that the tail of the blade may be slightly expanded or biased to be in firm engagement with the dovetail portion 38 of the shank.

Figure 4:
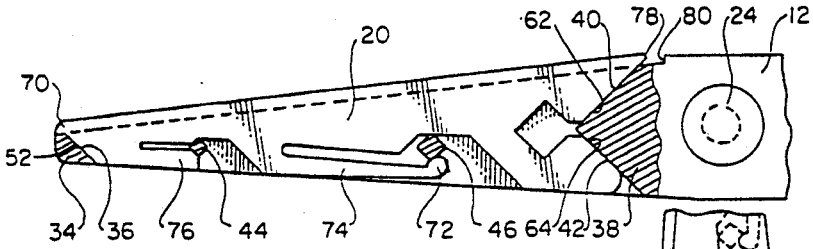
FIG. 4 is a view similar to the view of FIG. 3, illustrating the replaceable cutting blade in positive retention on the shank of the scissors after insertion and installation.

Referring now in detail to FIG. 4, it can be seen that the blade 20 has been indexed, registered and located within the opening 32 by means of the slopes, angled surfaces cooperating with conformal slopes and angular surfaces on the blade. The blade 20 is nested within the opening between the opposite sidewalls of the forward end of shank 12 so that a tip of the blade 70 rests against the nose portion 34 while the conformal surfaces 36 and 52 are in abuttment. The dovetail surfaces 40 and 42 are in alignment with the surfaces 62 and 64 so that the ends of the blade are biased outwardly. Thus, the forward and rear ends of the blade are prevented from being inadvertently removed from the opening 32.

It is to be particularly noted that positive retention of the blade within the opening is maintained by means of a snap-lock arrangement between an enlarged bead 72 on a resilient finger 74, which engages with the cross element or post 46. Also, the post 44 is in conformal mating with surfaces provided on a forward finger 76. Since the bead 72 is behind the post 46, a forward bias is maintaining the blade in position.

Figure 5:
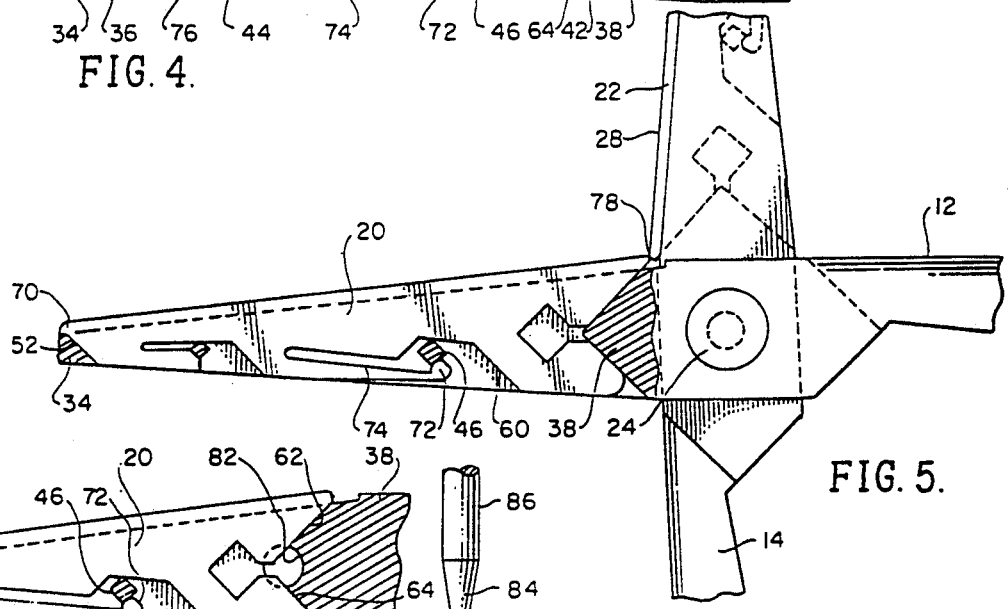
FIG. 5 is a view similar to the view of FIG. 4, illustrating automatic and forcible removal of a replaceable cutting blade by engagement of shoulders between blades carried on respective shanks of the scissors.

Referring now in detail to FIGS. 4 and 5, means are shown for automatic ejection of the replacement cutting blade 20, which comprises an exposed shoulder, identified by numeral 78, on the extreme rear end of the blade 20. The exposed shoulder 78 is terminated within a notch 80 provided in the forward end of the shank 12 immediately ahead and adjacent to the pivotal connection 24. Therefore, an open notch is provided immediately behind the shoulder 78 into which a removal implement may be placed to urge the blade 20 forwardly. When the retention is overcome of the bead 72 with the cross post 46, the blade will eject. One such implement is the opposite shank of the scissors. As shown in FIG. 5, both shanks and cutting blades are identical and when shank 14 is cocked so that the shoulders 78 of each blade are within the respective slots of each shank, engagement between the shoulders occurs. Once engaged, the scissors may be closed and the shanks converged, causing the shoulders to forcibly engage to eject the respective blades. In this latter instance, it is to be noted that the pivotal connection 24, or fastener, which is employed, usually has a relatively small diameter head surface. As a result, non-planar movement is permitted between the shank elements. Sufficient play is available to permit the shanks to be canted or cocked with respect to one another so that shoulder 78 engagement between the blades can occur. In the position shown in FIG. 5, such engagement is illustrated preparatory to closing of the scissors to effect ejection.

Figure 6:
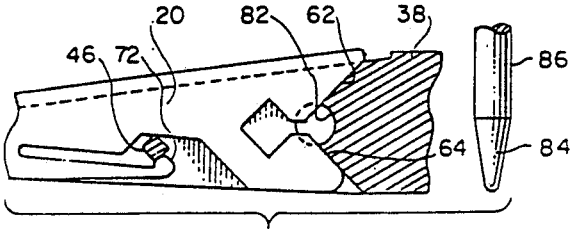
FIG. 6 is a fragmentary view, illustrating another means for removing a replaceable blade from a shank of the cutting device, using a removable pin.

Referring now in detail to FIG. 6, another means is illustrated for blade ejection which includes a circular aperture 82 provided through the dovetail portion 38 into which a tip 84 of a rod 86 is thrust. It is noted that the tip 84 is tapered or conical so that as the rod is further pushed through the aperture 82, the external surface of the conical tip 84 will engage with surfaces 62 and 64 of the rear end of blade 20. As the rod is pushed through the aperture, additional force urges the blade over the retention bead 72 so that the blade assumes the position shown in FIG. 3 and may be removed from the opening 32.

Therefore, in view of the foregoing, it can be seen that the cutting device of the present invention involves an implement having an opening for insertably receiving a replaceable cutting blade that may be readily introduced into a cavity or opening on the shank of the implement and forced into a retained position. The implement includes, in accordance with the invention, guide means for automatically directing the cutting blade into proper aligned position on the shank and includes indexing and registering means for locating the blade in the proper position. Such means is comprised of conformal surfaces cooperatively disposed on the cutting blade and the implement that work together for proper placement. Positive retention of the blade within the implement is assured by the snap-lock arrangement comprising the spring finger 74 with the bead 72 at its opposite end for releasable engagement with the post 46. Conformal surfaces on the implement not only include those on the nose portion 34 and the tail portion 38, but the surfaces on the posts 44 and 46. The mating or conformal surfaces on the blade include the forward sloping surface 52 and the dovetailed surfaces 62 and 64 on the tail end of the blade. Surfaces 54 and 56, as well as surface 60, cooperate with the surfaces on posts 44 and 46 to achieve registration and alignment.

Automatic ejection of the blades is achieved by means of the interlocking shoulders 78 of each blade when the shanks are cocked or slightly twisted, followed by closing of the shanks, or by use of a tapered rod 86 with the tip 84 inserted through aperture 82 behind the dovetailed surfaces 62 and 64.

The device is relatively inexpensive to manufacture as compared to other devices of high temper quality since the opening 32 conveniently may be prepared from bar stock by first passing a cutting tool from the top of the forward end of the shank through to create a slot between surface 36 and post 44. Next, a second pass is effected to provide a slot between posts 44 and 46, followed by a third pass to provide the slot between posts 46 and surface 42. Next, the cutter or broach is positioned so that a cut or slot is made between post 44 and the tip of the angled surface 36, followed by another pass of the cutter or broach to provide a slot at a different angle between posts 44 and 46. A final cut is then made between the surface 42 and the post 46 so that the opening 32 is now defined as illustrated. In this fashion, the posts 44, 46 and angled portions 34 and 38 are provided without requiring difficult cuts or dimensional provisions. Fabrication technique is relatively simple and uncomplicated so that mass production can be inexpensively achieved.

Figure 7:
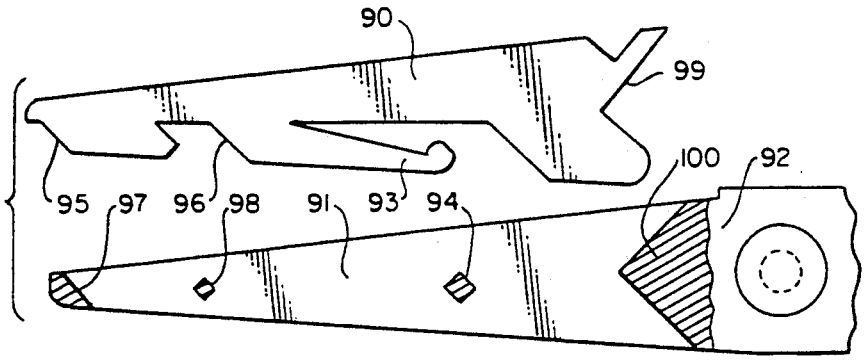
FIGS. 7 and 8 show different configurations for the blade and the shank into which it is insertably received.
Figure 8:
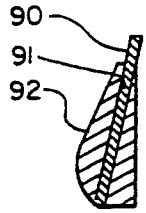

Referring now in detail to FIGS. 7 and 8, it can be seen that a different configuration is illustrated by which a blade 90 may be inserted into a slotted area 91 on the end of shank 92. The blade is captured in the slot by means of the interconnection of the spring-loaded arm 93 with the cross stud or piece 94. The front end of the blade, represented by sloping surface 95, and the sloping notched or open portion 96 cooperate with the sloping surface 97 of the shank as well as the cross stud 98 to guide and properly locate the blade within the slot 91. The wedge-shaped end of the blade, represented by numeral 99, conforms to the wedge shape 100 formed in the shank to terminate the end of slot 91 opposite from the end terminated by sloping surface 97.

As shown in more detail in FIG. 8, the blade 90 protrudes through the lower end of the shank 92.

Figure 9:
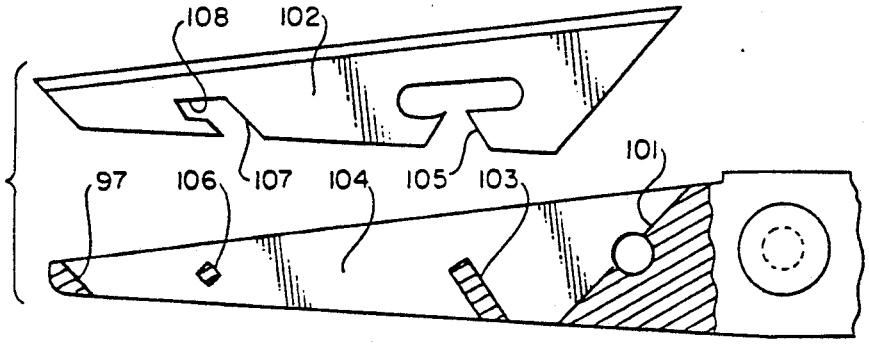
FIGS. 9 and 10 are views of an additional version of blade and shank.
Figure 10:
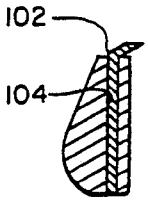

Referring now in detail to FIGS. 9 and 10, another embodiment of the invention is shown wherein the sloping surface 97 and the sloping surface 101 of the shank guide the blade 102 into position so that the cross piece 103 through the slot 104 engages with the notched opening 105 of the blade 102. The front cross piece 106 of the shank cooperates with the shape of notch 107 to accept the forward end of the blade while the lateral extension of the notch, indicated by numeral 108, serves to resiliently lock the blade in position.

Figure 11:
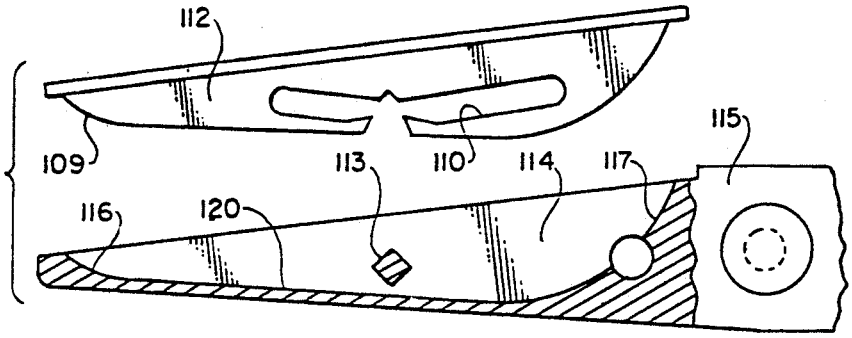
FIGS. 11 and 12 are views of still another version or configuration of blade and shank relationship.

FIG. 11 shows still a further version wherein the blade, represented by numeral 112, is substantially curved along its bottom, as represented by numeral 109, and includes both a guide and locking notch 110 adapted to be received over the cross piece 113 within the slot 114 of the shank 115. The opposite ends of the slot are curved at surfaces 116 and 117 to conform with the curved bottom portion of the blade 112. The extreme bottom portion may be flat; however, it is to be understood that the ends of the bottom are curved to conform with the shank curved surfaces 116 and 117.

Figure 12:
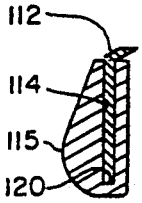

In FIG. 12, the shank is provided with a slot that terminates at its lower end so as to complete house the blade 112. Therefore, the slot 114 does not proceed all the way through the bottom and terminates in the flat area, represented by numeral 120.

Therefore, it can be seen that the scissors of the present invention are provided with disposable or replaceable inserts which have a main body which may be separately sterilized from the inserts which have been sterilized prior to use by gamma radiation or ethylene oxide gas light. The inserts may be easily inserted into the shanks of the scissors where the blades are positively engaged with the solid cross posts or elements by means of the spring-action arm carried on each of the blades. Each blade is guided by the configuration of the blade conforming with the configuration of the slot in the scissor shank as the aft end of the blade is lowered into it. Full insertion of the blade into the slot of the scissors shank locks the blade into its desired position. When the spring-action arms snap into place, the blades are then fully seated, secured and held rigid by the spring arms and the 45° V-slot on the aft end of the blades matching the 45° aft post in the slot of the scissor shank.

The inserts are loaded similarly to injector razors or the like and once seated, can only be removed by applying opposite pressure, such as by twisting one scissor shank with respect to the other so that the shoulders 78 engage and force the blades out of the respective slots. The slow, applied twisting motion will exert the force that is necessary to open the blade spring-lock for ejection. Blade exchange can be accomplished in a few seconds, thereby eliminating troublesome sharpening procedures and continuous paperwork. The cost of the blades is considerably less than the cost of resharpening and the convenience factor is obvious.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a cutting implement comprising a pair of elongated shanks, each having a shaped recess defined between contoured shoulders and opposing edges and being pivoted together midway between the opposite ends of each shank so that said opposing edges converge together as the shanks are closed toward one another, the improvement which comprises:

a blade having a cutting edge and shaped forward and tail ends conformal to said contoured shoulders whereby retention of said blade is produced when said blade is inserted into said shank recess;

said blade includes a guide edge carried opposite to said cutting edge;

a retention slot provided on said blade;

said blade guide edged having at least one open-ended cutout leading into said retention slot;

said shaped forward and tail ends cooperate with said retention slot to releasably hold said blade in said shaped recess;

guide means cooperatively carried on each of said shanks and said blade for cooperatively positioning said blade into said respective shank recess to effect conformal mating of said shaped forward and tail ends of said blade with said shank contoured shoulders;

said guide means comprises at least one post laterally projecting outwardly from said shank recess in fixed spaced-apart relationship with respect to each other and with respect to said shank contoured shoulders;

said post of each shank being insertably received within said blade retention slot to guide and retain said blade in captive position on said shank exposing said cutting edge.

2. A replaceable single blade for a cutting shank comprising:

a cutting shank;

an elongated blade having opposite ends separated by a mid-section.

said mid-section provided with an opening leading to an elongated central slot normal to said opening;

a retention nub carried on said blade at an interjunction of said opening with said slot;

said cutting shank having opposite ends with sloping angular shoulders; and said blade opposite ends being of angular sloping configuration operable in cooperation with said opening for alignment and registration with said cutting shank sloping shoulders.

* * * * *